United States Patent [19]

Glass

[11] 4,269,010

[45] May 26, 1981

[54] MULTI FIN POST ANCHOR SYSTEM

[76] Inventor: Carl R. Glass, 1036 Partin Dr., Kissimmee, Fla. 32741

[21] Appl. No.: 96,267

[22] Filed: Nov. 21, 1979

[51] Int. Cl.[3] ..... E04N 12/20

[52] U.S. Cl. ..... 52/154; 52/166; 52/298

[58] Field of Search ..... 52/166, 165, 170, 153, 52/154, 298, 297

[56] References Cited

U.S. PATENT DOCUMENTS

| | | | |
|---|---|---|---|
| 131,037 | 9/1872 | Sprout | 52/154 |
| 373,240 | 11/1887 | Logan | 52/154 |
| 510,625 | 12/1893 | Wright | 52/154 |
| 612,052 | 10/1898 | McMullen | 52/154 |
| 798,945 | 9/1905 | Berntson | 52/154 |
| 1,114,724 | 10/1914 | Blackburn | 52/166 |
| 2,252,379 | 8/1941 | Johns | 52/166 |
| 3,032,149 | 5/1962 | Marghise | 52/156 |
| 3,691,776 | 9/1972 | Hall | 52/296 |
| 3,694,978 | 10/1972 | Mintz | 52/298 |
| 3,727,357 | 4/1973 | Stillman | 52/154 |

FOREIGN PATENT DOCUMENTS

| | | | |
|---|---|---|---|
| 326284 | 7/1970 | Sweden | 52/297 |

*Primary Examiner*—Price C. Faw, Jr.
*Assistant Examiner*—Henry E. Raduazo
*Attorney, Agent, or Firm*—Sughrue, Rothwell, Mion, Zinn and Macpeak

[57] ABSTRACT

A post anchor system for embedded posts has a plurality of post anchors formed preferably of a non-metallic material. Each anchor has a tubular main sleeve with interior splines to engage the post. A disc member extends horizontally from a midlength position on the sleeve and upper and lower radial fin members extend from the sleeve and are also joined to the disc. The fin members are positioned at space locations relative to one another so as to present maximum resistance to movement of the embedded post in the earth.

3 Claims, 3 Drawing Figures

MULTI FIN POST ANCHOR SYSTEM

BACKGROUND OF THE INVENTION

1. Field of the Invention

This invention pertains to post anchor means utilized with fence posts, sign posts, mailbox posts, and the like.

2. Statement of the Prior

Earlier proposals in this field have included radially arranged fins. Representative patents are listed as follows:

| Patentee | Patent No. | Issue Date |
|---|---|---|
| W. P. Logan | 373,240 | Nov. 15, 1887 |
| D. S. McMullen | 612,052 | Oct. 11, 1898 |
| T. Bernston | 798,945 | Sept. 5, 1905 |
| J. Blackburn | 1,114,724 | Oct. 27, 1914 |
| F. V. Manghise | 3,032,149 | May 1, 1962 |
| Mintz | 3,694,978 | Oct. 3, 1972 |
| Stillman, Jr. | 3,727,357 | Apr. 17, 1973 |

SUMMARY OF THE INVENTION

The installation of fence posts, and other posts, by municipal and highway authorities and by fencing contractors, has long presented a difficult problem of time consumption and economics. With a view to resolution of these difficulties, the invention herein disclosed provides an efficient and effective system for post installation which is rapid, eliminates the need for concrete footings, and employs economical components.

The present invention employs a plurality of new and novel post anchors, each having a post engaging sleeve, a horizontal disc, and series of upper and lower discs each connected at both the sleeve and the disc. The fins are oriented to maximize resistance to movement of the embedded post in the earth.

The anchor components hereof are preferably formed of a durable and break resistance, non-metallic material, such as reclaimed auto battery cases, or the like.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
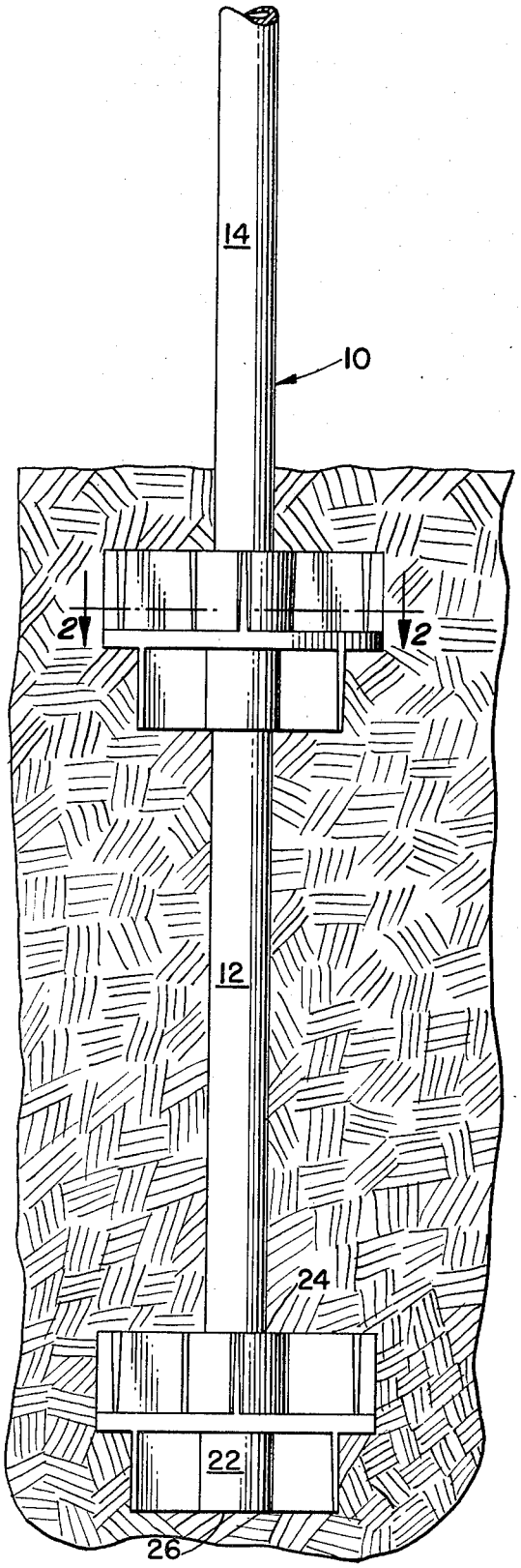
FIG. 1 is a side elevational view showing a post and anchoring system according to this invention, as embedded in the earth.
Figure 2:
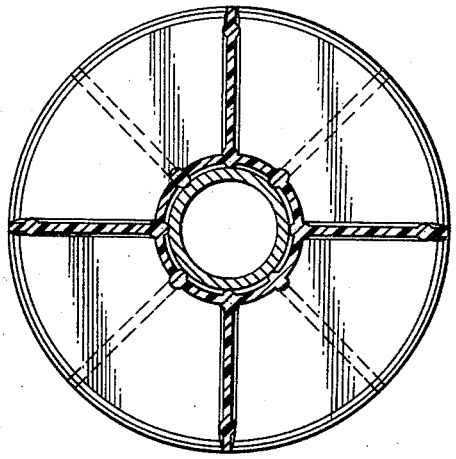
FIG. 2 is an enlarged sectional view taken on line 2—2, of FIG. 1, looking in the direction of the arrows.
Figure 3:
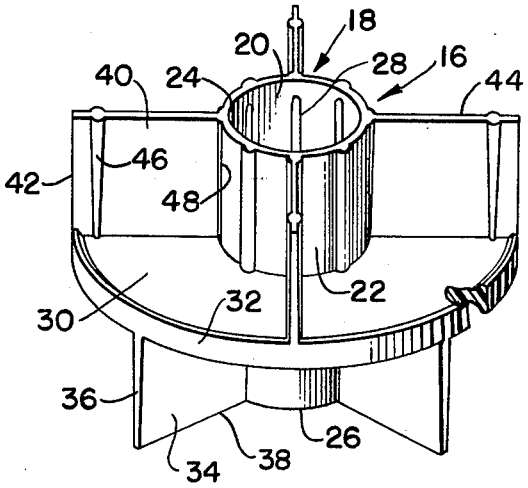
FIG. 3 is a perspective view of one of the post anchor components hereof.

Referring to the drawing in more detail a typical environment of use of this invention is shown in FIG. 1. There, the post anchor system is shown in place on a tubular post 10 formed of metal or the like. The post 10 has a lower portion 12 embedded in the earth, and an upper portion 14 projecting thereabove.

The anchor system comprises of a plurality, preferably two, of post anchors 16. Each of these includes a vertical main sleeve portion 18 having an inner sleeve surface 20 and outer sleeve surface 22. As oriented in use, the sleeve has a top end 24, and an opposite bottom end 26.

In order that the sleeve may be fitted on the post and slidably positioned thereon at a selected location, a plurality of radially spaced, elongated vertical splines 28 project inwardly from the inner sleeve surface 20. The splines, formed of the same material of fabrication as the overall device, are slightly resilient, but effectively grip the post when the anchor is located thereon.

At a midlength location on the sleeve, a substantially flat, horizontal disc 30 extends from the outer surface thereof. The disc 30 has a vertical flange 32 about its outer perimeter.

A plurality of lower fin members 34 extends from the outer sleeve surface below the disc 30. The fins members 34 are of substantially rectangular configuration, and each has an outer edge 36 which is vertically coextensive with the disc flange 32, and a lower edge 38 laterally occupying the same horizontal plane as the bottom end 26 of the sleeve. The fin members 34 are integrally joined both to the disc and to the sleeve. As seen in the drawings, in the preferred embodiment of the invention, the discs are four in number and are arranged at 90° segmental locations about the sleeve.

Similarly, a like plurality of upper radial fin members 40 extends from the sleeve outer surface on the opposite or upper side of the disc. The fin members 40 have outer vertical edges 42 aligned with the flange 32, and top edges 44 laterally aligned in the plane of the top end 24 of the sleeve. The fins are integral with the sleeve and the disc, and each has a rigidifying vertical brace 46 molded therein, and strengthening ribs 48 are also provided at their respective junctures with the sleeve. Like the lower fins, there are preferably four upper fins, arranged at substantially 90° relative to one another about the sleeve. The disposition of the upper fins relative to the lower fins is however rotated by substantially 45° so that the angle of disposition of the upper and lower fins relative to one another maximizes the resistance to earth movement of the post, as appears below.

In use, and in a preferred method of installation, a post hole of a diameter approximately that of one of the anchors 16 is formed in the earth. One of the anchors 16 is positioned on the portion 12 of the post to be embedded at or near the bottom thereof, and the post and anchor are seated in the post hole and plumbed. Thereafter, maintaining plumb, fill earth is tamped about the post to a selected height. At such height, a second anchor 16 is placed on the post and driven to the depth of the fill and into the fill to the disc. Thereafter, additional fill is tamped to ground level. Inasmuch as the fins radiate in a maximum number of directions, the possibility of later dislocation of the post is thereby minimized.

I claim:

1. A post anchor formed of non-metallic material for use with an elongated post having a portion embedded in the earth, the post anchor comprising:

a main sleeve portion having an inner sleeve surface and an outer sleeve surface, and having a top end and a bottom end;

a series of radially spaced, elongated, inwardly projecting, vertical splines on the inner sleeve surface;

a substantially flat horizontal disc member extending from the outer sleeve surface at a midlength location between the top and bottom ends of the sleeve;

the disc member having a peripheral vertical flange extending about the perimeter thereof;

a plurality of lower radial fin members extending from the outer sleeve surface, the fin members having outer edges coextensive with the flange, and lower edges coextensive with the bottom end of the main sleeve portions;

a plurality of upper radial fin members extending from the outer sleeve surface, at locations intermediate the locations of the lower fin members, the upper fin members having vertical edges coextensive with the flange, and upper edges coextensive with the top of the main sleeve, the upper fins having rigidifying vertical braces incorporated therein adjacent the vertical edges thereof;

strengthening ribs on the outer sleeve surface extending from the disc members to the top of the main sleeve portions;

the post anchors being adapted to be engaged on the portion of the post embedded in the earth with the vertical splines and frictional engagement therewith such that the fins resist lateral movement in the earth of the post.

2. The invention of claim 1 wherein:

the lower fin members comprise diametrically right angularly arranged pairs thereof;

the upper fin members comprise diametrically right angularly arranged pairs thereof;

the respective pairs are arranged at intersecting angles relative to one another.

3. The combination, with a fence post to be embedded in the earth, of a pair of post anchors, each comprising:

a main sleeve portion having an inner sleeve surface and an outer sleeve surface, and having a top end and a bottom end;

a series of radially spaced, elongated, inwardly projecting, vertical splines on the inner sleeve surface;

a substantially flat horizontal disc member extending from the outer sleeve surface at a midlength location between the top and bottom ends of the sleeve;

the disc member having a peripheral vertical flange extending about the perimeter thereof;

a plurality of lower radial fin members extending from the outer sleeve surface, the fin members having outer edges coextensive with the flange, and lower edges coextensive with the bottom end of the main sleeve portions;

a plurality of upper radial fin members extending from the outer sleeve surface, at locations intermediate the locations of the lower fin members, the upper fin members having vertical edges coextensive with the flange, and upper edges coextensive with the top of the main sleeve, the upper fins having rigidifying vertical braces incorporated therein adjacent the vertical edges thereof;

strengthening ribs on the outer sleeve surface extending from the disc members to the top of the main sleeve portions;

the post anchors being adapted to be engaged on the portion of the post embedded in the earth with the vertical splines in frictional engagement therewith such that the fins resist lateral movement in the earth of the post;

the first of the post anchors being engaged about one end of the post and the second of the post anchors being engaged about the post at a locations spaced upwardly of the first post anchor.

* * * * *